US005704468A

United States Patent [19]

Lust et al.

[11] Patent Number: 5,704,468

[45] Date of Patent: Jan. 6, 1998

[54] PACKAGING ARRANGEMENT FOR CONTACT LENSES

[75] Inventors: Victor Lust; Richard Wayne Abrams, both of Jacksonville; Stephen Robert Beaton, Neptune Beach; Kornelis Renkema, Jacksonville, all of Fla.; Wybren van der Meulen, Neunen, Netherlands; Jongliang Wu; Daniel Tsu-Fang Wang, both of Jacksonville, Fla.

[73] Assignee: Johnson & Johnson Vision Products, Inc., Jacksonville, Fla.

[21] Appl. No.: 536,105

[22] Filed: Sep. 29, 1995

[51] Int. Cl.[6] ..... B65D 11/04

[52] U.S. Cl. ..... 206/5.1; 206/205; 206/471

[58] Field of Search ..... 206/5.1, 205, 461, 206/467, 471, 484, 562–563

[56] References Cited

U.S. PATENT DOCUMENTS

| | | | |
|---|---|---|---|
| 3,202,280 | 8/1965 | Larson | 206/471 |
| 3,442,378 | 5/1969 | Wolfe | 206/564 |
| 4,691,820 | 9/1987 | Martinez | 206/205 |
| 4,988,004 | 1/1991 | Intini | 206/532 |
| 5,054,610 | 10/1991 | Ajello | 206/5.1 |
| 5,409,104 | 4/1995 | Lovell | 206/5.1 |
| 5,467,868 | 11/1995 | Abrams et al. | 206/5.1 |
| 5,474,169 | 12/1995 | Bauman | 206/5.1 |

FOREIGN PATENT DOCUMENTS 64-74525 3/1989 Japan .

*Primary Examiner*—Paul T. Sewell
*Assistant Examiner*—Luan K. Bui

[57] ABSTRACT

A packaging arrangement for the containment in a blister package of at least one hydrophilic contact lens in a sterile aqueous solution. Provision is made for incorporating support structure in the form of stiffening groove or wall elements in flanges of base members of the blister packages to facilitate an improved attachment between the base members of the blister packages housing the contact lenses, and a flexible cover sheet utilized for sealing engagement with the base members while incorporating additional strength to the blister package structures.

44 Claims, 3 Drawing Sheets

PACKAGING ARRANGEMENT FOR CONTACT LENSES

BACKGROUND OF THE INVENTION

1. Field of the Invention

The present invention relates to a packaging arrangement for the containment of at least one hydrophilic contact lens in a sterile aqueous solution. More specifically, the invention pertains to a packaging arrangement wherein a plurality of disposable hydrophilic contact lenses are contained in a specific number of individual packaging arrangements in the shape of blister packages which are adapted to be collectively housed in a suitable receptacle structure, such as a box-like container or carton so as to provide a specified or essentially requisite supply of contact lenses for use by a consumer over a predetermined period of time.

In particular, the invention is directed to the aspect of incorporating support structure in the form of stiffening rib or grooved wall elements to flanges of base members to facilitate an improved attachment between the base members of the blister packages housing the contact lenses, and a flexible cover sheet utilized for sealing engagement with the base members while incorporating additional strength to the blister package structures.

2. Discussion of the Prior Art

The packaging of hydrophilic contact lenses in a sterile aqueous solution is well known in the contact lens manufacturing technology. In particular, such packaging arrangements frequently consist of so-called blister packages which are employed for the storage and dispensing of the hydrophilic contact lenses by a medical practitioner or to consumer who intends to wear the contact lenses. Generally, such hydrophilic contact lenses, which may be disposable after a single wear or short-term use, are manufactured from suitable hydrophilic polymeric materials. These materials may be, amongst others, copolymers of hydroxyethyl methacrylate (HEMA) containing from about 20% to 90% or more of water, depending upon the polymer composition. Ordinarily, such contact lenses must be stored in a sterile aqueous solution, usually consisting of an isotonic saline solution, in order to prevent dehydration and to maintain the lenses in a ready-to-wear condition.

Heretofore, contact lens manufacturers normally utilized stoppered glass bottles containing sterile saline solutions into which the hydrophilic contact lenses were immersed, as storage and shipping containers for individual contact lenses. Each bottle was sealed with a suitable silicone stopper and provided with a metal closure as a safety seal in the configuration of an overcap. When the contact lens was intended to be removed from the bottle for use by a patient, the metal closure safety seal was required to be initially torn off the bottle, thereafter the stopper withdrawn and the lens lifted out from the bottle through the intermediary of a suitable plastic tweezer or pouring out of the contents. This entailed the need for the implementation of an extremely complicated procedure, since the contact lens was difficult to grasp and remove from the saline solution contained in the bottle due to the transparent nature of the contact lens which rendered it practically invisible to or at least extremely difficult to ascertain by the human eye.

More recently, containments in the form of blister packages have been developed for hydrophilic contact lenses, and which enable the storage and shipping of the hydrophilic contact lenses in an expediently simple and inexpensive manner, while concurrently facilitating the conveniently easy removal of the contact lens by a medical practitioner or a patient.

For instance, a blister package which is adapted to provide a sterile sealed storage environment for a disposable or single-use hydrophilic contact lens, wherein the lens is immersed in a sterile aqueous solution; for example, such as in an isotonic saline solution, is described in U.S. Pat. No. 4,691,820 to Martinez; which is assigned to the common assignee of the present application, and the disclosure of which is incorporated herein by reference.

Thus, in the above-mentioned Martinez U.S. patent, the blister package for storing and dispensing a hydrophilic contact lens includes an injection-molded or thermoformed plastic base member incorporating a molded cavity which is surrounded by an outstanding planar flange about the rim of the cavity. A flexible cover sheet is adhered to the surface of the flange so as to sealingly enclose the cavity in a generally liquid-tight mode. Within the cavity of the base portion, a hydrophilic contact lens is immersed in a sterile aqueous solution, such as an isotonic saline solution. A portion of the side wall of the cavity is inclined to form a ramp extending upwardly towards the flange from the bottom of the cavity, and the cover sheet is adapted to be stripped from the flange in order to expose the cavity and inclined side wall thereof whereupon the lens may be readily manually removed by being slid upwardly and out of the cavity along the inclined ramp surface of the cavity.

Other embodiments of blister packages have the lens-containing cavity shaped to be of an essentially semi-spherical configuration which is dimensioned so as to be adapted to closely support the contact lens therein while immersed in an aqueous solution, for ease of removal and also to facilitate an inspection process, as disclosed in copending U.S. patent application Ser. Nos. 08/257,796, filed Jun. 10, 1994; 08/414,513, filed Mar. 31, 1995; 08/414,515, filed Mar. 31, 1995 and 08/414,514, filed Mar. 31, 1995, each also being commonly assigned to the assignee of the present application and the disclosures of which are incorporated herein by reference. Moreover, the foregoing constructions primarily consider the utilization of such blister packages for the dispensing of individual contact lenses, with such blister packages being ordinarily separate or single packagings or interconnected arrays of blister packages, which may then be housed in larger quantities in further containments, such as a rigid cardboard or paperboard carton of usual construction as employed for the retail sale of the lenses; or possibly encased by a suitable shrink-wrap film.

It is an important commercial aspect to be able to furnish a user of such disposable hydrophilic contact lenses with a specific supply of contact lenses, the latter of which are normally worn for only a single day; in essence, for ordinarily 8 to 18 hours within a 24-hour period and thereafter discarded. Hereby, the packaging of a supply of contact lenses should enable the user to store and provide indication for replenishing the supply of contact lenses at regular intervals; for example, at periods of 5, 10, 15, 30 days or even longer. Consequently, provision is made for packaging arrangements including specified quantities of such hydrophilic contact lenses contained in blister packages, such as being in suitable interconnected or loosely positioned arrays, wherein these packaging arrangements are adapted to be boxed in a carton enabling a rapid and precise determination as to the quantity of hydrophilic contact lenses contained therein, and with such packaging arrangements being of a compact nature which is completely protective of the hydrophilic lenses.

SUMMARY OF THE INVENTION

In essence, the inventive concept pertains to packaging arrangements in which blister packages each possess a thermoformed or injection-molded base member which has a cavity containing respectively one hydrophilic contact lens in a sterile aqueous solution. A specified quantity of such blister packages may the molded plastic base members thereof each containing a contact lens positioned in a contiguous array, and is initially covered by a preferably, although not necessarily, single flexible cover sheet which may be constituted of a laminated foil or other materials, such as metallized PET, PC to enhance barrier properties, or a layer of a suitable clear plastic laminate including a silicon oxide barrier layer to provide barrier properties against the transmission therethrough of oxygen, water, bacteria or the like, in order to provide a sealed environment for each of the contact lenses contained in the cavity formed in each base member. The flexible cover sheet may be dimensioned to cover a single base member to provide an individual or single packaging arrangement, or, in an alternative concept, may be in the form of strips whereby adjoining arrays or base members are severably interconnected to enable the dispensing of individual blister packages each containing one of the hydrophilic contact lenses as may be required by a user. In particular, a plurality of such arrays of packaging arrangements for contact lenses, which arrays or individual blister packages are adapted to be arranged in one or more containers.

Each of the blister package base members may possess a preferably substantially rectangular outstanding planar flange encompassing a respective contact lens-receiving cavity formed therein, the latter of which may be offset towards one end of the flange, and with the flange incorporating integral support structure formulating rigidly enhanced strength and compact packaging arrangements such that the cavities containing the hydrophilic contact lenses of superimposed arrays are substantially protected against potentially damaging external influences, such as shocks or impacts which may be imparted thereto during handling thereof.

Each molded plastic base member of a blister package may be constituted from a suitable injection-molded or thermoformed thermoplastic material, such as, for instance, polypropylene, PET, PC and other thermoplastic materials; whereas the flexible cover sheet may be constituted of a foil or clear plastic laminate incorporating a barrier material, such as silicon oxide as mentioned hereinabove, suitably imprinted and which is adapted to be heat-sealed to the flange of the base member extending about the cavity containing the hydrophilic contact lens in a sterile aqueous solution. The flexible cover sheet may be of a material composition and imprinted in a novel manner as is disclosed in copending U.S. patent application Ser. No. 08/106,386; filed on Aug. 13, 1993; entitled "Method of Double-Sided Printing of a Laminate and Product Obtained Thereby" (Attorney's Docket No. VTN-89, 9013), commonly assigned to the assignee of the present application and the disclosure of which is incorporated herein by reference, although other laminated materials readily lend themselves for this purpose; for example, as disclosed in copending U.S. patent application Ser. No. 08/536,160.

In order to attain a stiffening or reinforcing effect for the base member, the base member as described hereinbelow is equipped with peripheral downwardly extending rib or wall portions depending from the flange, whereby such reinforcing rib or wall portions may comprise a depending continuous wall extending along at least a major extent of the flange surface. This, in essence, stiffening or reinforcing effect produced thereby enables the base member to be substantially stiffened or strengthened against deflection of distortion so as to enable appropriate application heat-sealing attachment of the flexible cover sheet thereto, thereby assuring proper sealing of the contents of the cavity, in effect, the contact lens which is immersed therein in the sterile aqueous solutions. The depending reinforcing rib or well portions, or in essence, the depending wall, may also serve as a locating structure for handling and/or manufacturing processes.

Pursuant to a specific feature of the invention, the base member is provided with a raised flange surface portion encompassing the contact lens-receiving cavity so as to ensure that at least the cavity is appropriately sealed by the flexible cover sheet, while enabling remaining portions of the flexible cover sheet which contact the other outwardly located flange surface areas to be selectively sealed thereto, or only loosely positioned thereon at various locations to provide a finger-engagable structure which facilitate peeling off and separation of the flexible cover sheet from the base member by a user when access is sought to the contact lens which is contained in the cavity of the base member.

Although the foregoing is described with regard to blister packages each having a base member containing a hydrophilic contact lens in an ordinarily semi-spherical cavity, the inventive structure is equally applicable to blister packages with base members having a cavity in the shape of a generally rectangular configuration with an upwardly sloping ramp surface as described in the above-mentioned U.S. Pat. No. 4,691,820 to Martinez.

Pursuant to an embodiment of the invention, it is also possible to form a peripheral groove in the edge portion of the flange surface extending along a portion of the rectangular confines of the base member and forming a stiffening structure, while concurrently enabling the material of the flexible cover sheet to be pressed into engagement with the peripheral groove, thereby forming a sealing connection with the base member.

Accordingly, it is an object of the present invention to provide a novel construction of base members for blister packages each containing a cavity housing a hydrophilic contact lens immersed in an aqueous solution, whereby a depending stiffening or reinforcing wall portion extends downwardly from a flange of the base member along at least a portion of the peripheral extent thereof.

Yet another object of the present invention is to provide for the attaching of a flexible cover sheet to a flange portion of a base member for a blister package through effectuating a sealing engagement between the material of the flexible cover sheet and a raised surface structure in the flange portion of the base member for sealing enclosing a contact lens-receiving cavity in the base member.

BRIEF DESCRIPTION OF THE DRAWINGS

Reference may now be had to the following detailed description of exemplary embodiments of the invention, taken in conjunction with the accompanying drawings; in which.

DETAILED DESCRIPTION OF PREFERRED EMBODIMENTS

Figure 1:
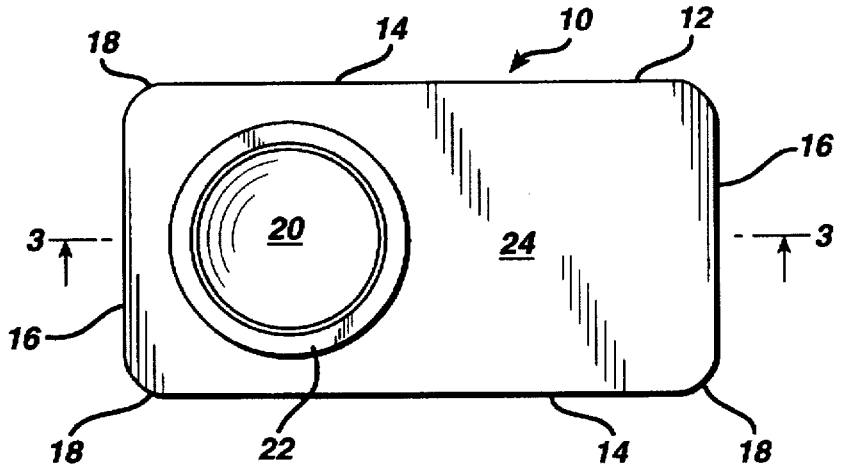
FIG. 1 illustrates a top plan view of a first embodiment of a base member for a blister package pursuant to the invention.
Figure 2:
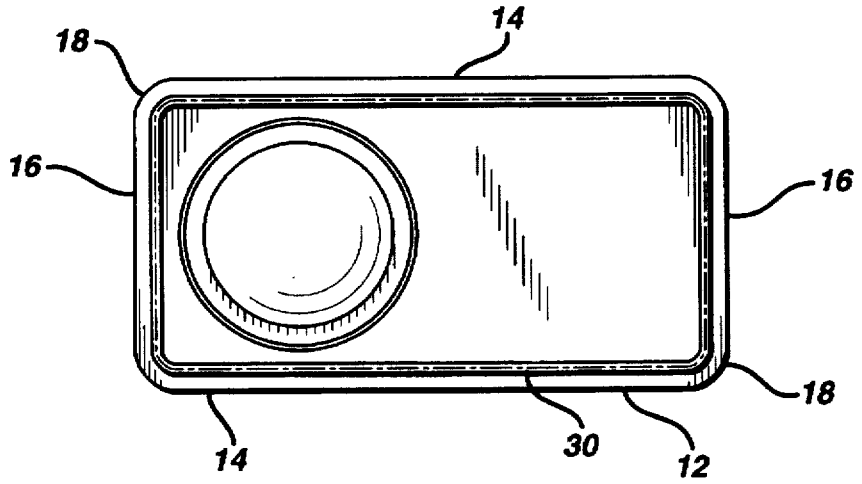
FIG. 2 illustrates a bottom view of the base member of FIG. 1.

Referring now in specific detail to the first embodiment of a blister package construction, particularly as represented in FIGS. 1 to 4 of the drawings, FIG. 1 illustrates a top plan view of a base member 10 which is preferably constituted of an injection-molded or thermoformed plastic material, such as polypropylene. The base member 10 includes a planar and substantially rectangular flange 12 having elongate parallel side edges 14 and end edges 16, and whereby the generally rectangular flange 12 may have rounded end corners 18 as shown, although these end corners 18 may also be readily sharp or of chamfered configuration.

Figure 3:
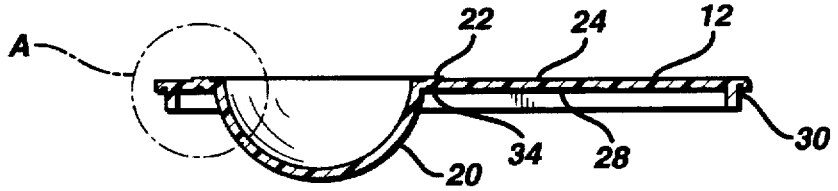
FIG. 3 illustrates a sectional view of the base member taken along line 3—3 in FIG. 1.
Figure 4:
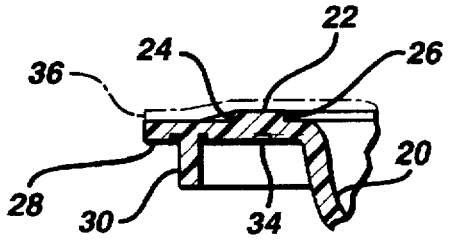
FIG. 4 illustrates an enlarged fragmentary view of the encircled portion A in FIG. 3.
Figure 5:
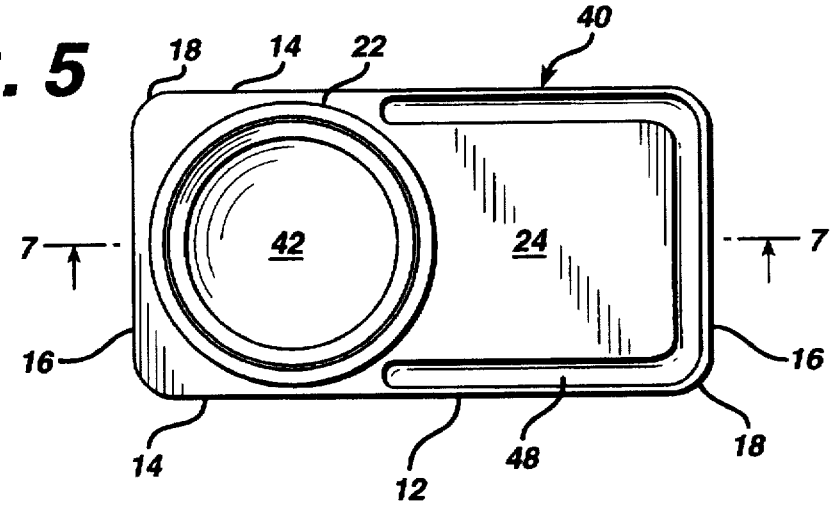
FIG. 5 illustrates a top plan view of a second embodiment of a base member for a blister package pursuant to the invention.

As illustrated in drawing FIGS. 3 and 4, a cavity 20 for receiving a single contact lens (not shown) in a sterile saline solution is formed in the flange 12, whereby the cavity may possess a generally hemispherical configuration, and is offset towards one end edge 16 of the planar flange 12, although equidistantly or centered between the side edges 14. A raised surface portion 22 of the upper planar surface 24 of the flange 12 surrounds the cavity 20, with an inner edge 26 of surface portion 22 being at a small distance radially outwardly thereof so as to form an annular raised flat or slightly convex plane relative to the remaining upper planar surface 24 of the rectangular flange 12.

Extending downwardly from the lower surface 28 of the rectangular flange 12 and closely inwardly offset with regard to the peripheral edges 14, 16 thereof is a depending rib or wall structure 30 which extends continuously within the entire perimeter of the rectangular flange 12. The depending wall structure or rib 30, which is integrally formed with the flange 12, is essentially a stiffening or reinforcing element imparting an enhanced rigidity and strength to the base member extending about the cavity 20. Moreover, the depending wall structure or rib 30 may serve as a locating feature during the handling and/or manufacture of the blister package.

Furthermore, the lower surface 28 of the flange 12 extending about the cavity may be provided with a small annular undercut 34 below raised surface portion 22, which may impart some degree of flexibility to the flange 12 relative to the cavity 20 containing the contact lens.

A flexible cover sheet 36, shown in phantom lines, which may be a foil or clear plastic laminate as described in the copending applications referred to hereinabove, may be either adhesively fastened or heat-sealed to regions of the upper surface 24 of the flange and the raised surface portion 22 so as to seal the contact lens in the cavity 20, and may also be expediently heat-sealed to different upper surface areas of the flange 12. For instance, one edge of the flexible cover sheet 36 which extends towards one of the end edges 14, 16 of the flange 12 adjacent the cavity 20, may be loosely positioned externally of the circumferential raised surface 22 so as to provide a finger-gripping portion for a user attempting to peel the flexible cover sheet from the base member 10 while permitting the remaining essentially handle-shaped portion of the flange 12 formed between the cavity 20 and the distal end edge 16, as shown in FIG. 3, to be held by the user while the flexible cover sheet 36 is being peeled away from the cavity 20, thereby enabling access to the contents therein; in effect, the contact lens.

With regard to the second embodiment of a base member 40, as illustrated in FIGS. 5 to 9 of the drawings, in which elements which are similar to or identical with those in FIGS. 1 to 4 are identified by the same reference numerals, in this instance a generally flat and rectangular flange 12 of base member 40 has a cavity 42 for receiving a contact lens offset toward one end 16 thereof, while centered between side edges 14. The cavity 42 is configured whereby an upper portion 44 thereof extending into the upper planar surface 24 of the flange 12 is of a generally upwardly widening funnel-shaped or frusto-conical annulus which at its lower end 46 merges into a curvilinear or semi-spherical bottom 48. This may assist in rendering the withdrawal of the contact lens easier for a user. As in the previous embodiment of FIGS. 1 to 4, the lens-receiving cavity 42 is at its upper end encompassed by a raised annular surface portion 22 extending above the upper planar surface 24 of flange 12 and whereby the flexible cover sheet 36 may be adhesively heat-sealed thereto so as to sealingly enclose the cavity 42 while being sealed also to various other upper surface portions of the flange 12.

Figure 6:
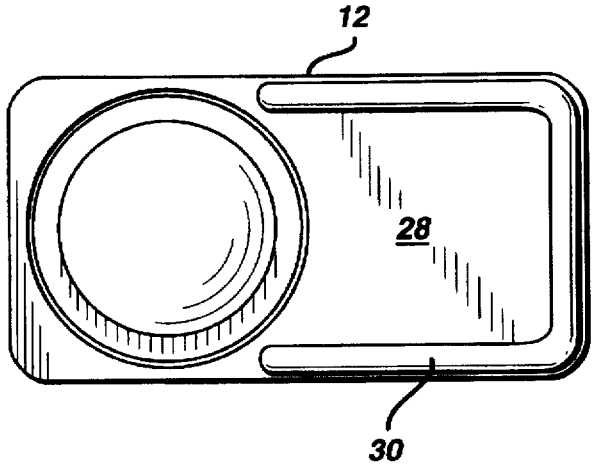
FIG. 6 illustrates a bottom view of the base member of FIG. 5.
Figure 7:
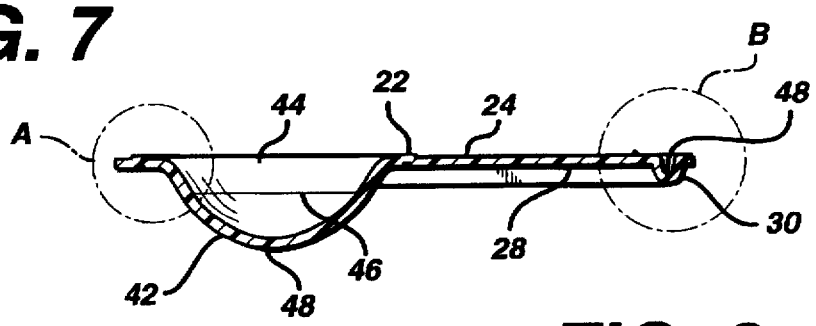
FIG. 7 illustrates a sectional view of the base member taken along line 7—7 in FIG. 5.

As illustrated in FIGS. 6 and 7, in this embodiment extending inwardly of and proximate to the side edges 14 and the one end edge 16 which is distant from cavity 42, is groove 48 in the upper planar surface 24 of flange 12 so as to define a "U" in which the legs thereof terminate proximate the exterior of cavity 42.

Figure 9:
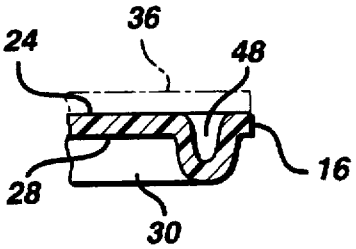
FIG. 9 illustrates an enlarged fragmentary view of the encircled portion B in FIG. 7.
Figure 10:
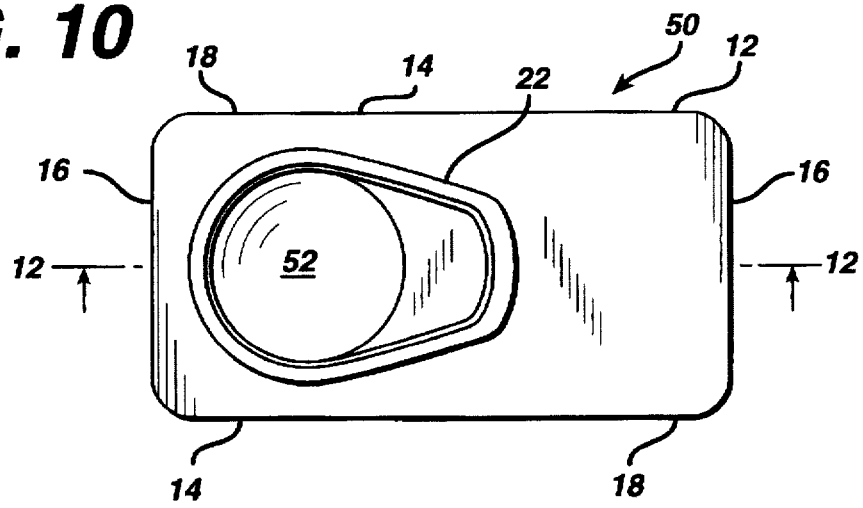
FIG. 10 illustrates a top plan view of a third embodiment of a base member for a blister package pursuant to the invention.
Figure 11:
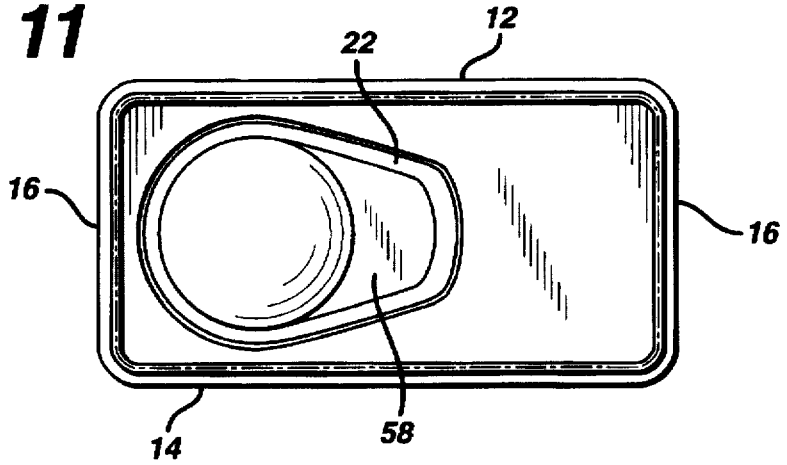
FIG. 11 illustrates a bottom view of the base member of FIG. 10.
Figure 12:
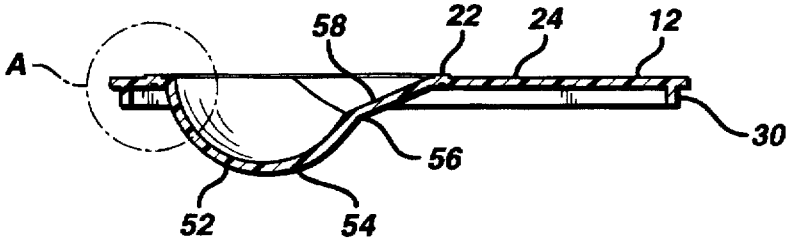
FIG. 12 illustrates a sectional view of the base member taken along line 12—12 in FIG. 10.

In transverse cross-section, as shown in the enlarged fragmentary detail in FIG. 9, which represents encircled part "B" in FIG. 7, the groove 48 is of a downwardly extending U-shape, so as to have the structure thereof form a reinforcing or stiffening wall element for the base member 40. If desired, portions of the cover sheet 36, when superimposed and adhesively or heat-sealingly fastened to the flange 12 may be pushed into the U-shaped groove 48 extending along the three sides of the flange, the opposite end where the flexible cover sheet 36 may extend beyond the annular raised surface portion 22 encompassing the cavity 42 may be loosely positioned on the flange 12 so as to provide a finger-gripping end for aiding a user in peeling the flexible cover sheet 36 off the base member 40.

Figure 8:
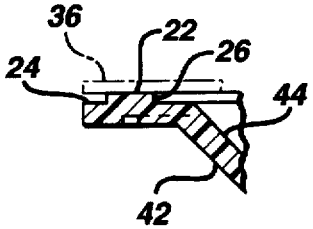
FIG. 8 illustrates an enlarged fragmentary view of the encircled portion A in FIG. 7.

The annular raised surface 22, as shown by insert A in FIG. 7 and in enlarged detail in FIG. 8 of the drawings, may have a flat or slightly convexly curved surface raised above the remaining upper surface 24 of the planar flange 12, so as to provide a good contact surface for heat-sealing the flexible cover sheet 36 thereto about the cavity 42.

Similarly, the groove 48 extending along the three edges of the planar flange 12, as more specifically illustrated in FIG. 9, may be dimensioned so as to be able to receive tucked-in or pressed-in portions of the flexible cover sheet 36 in the event that such engagement is desired for retaining the flexible cover sheet to the base member of the complete blister package in that manner.

Figure 13:
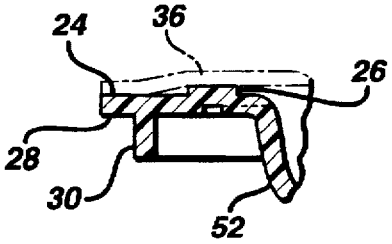
FIG. 13 illustrates an enlarged fragmentary view of the encircled portion A in FIG. 12.

As illustrated in the third embodiment of the invention, as shown in FIGS. 10 to 13, in this instance the construction of the base member 50 is quite similar to that of the base member 10 in the embodiment of FIGS. 1 to 4, whereby similar or identical elements are identified with the same reference numerals. However, in this embodiment the lens-receiving cavity 52 is configured such that the curvilinear or semi-spherical portion 54 thereof extends at one end 56 into an upwardly inclined ramp 58 which is, in plan view, of a trough-like frusto-conically or tapered narrowing shape and has an outwardly curved or convex end surface 60 where it meets the flange 12. This inclined ramp 58 also forms an aid to a user enabling the easier removal of the contact lens from the cavity 52 by a smooth and reliable sliding method in the displacement of the lens upwardly along the ramp surface. The peripheral dimensions of the contact lens-receiving cavity 52 and ramp 58 extend into a peripheral surface 62 which is raised above the upper surface 24 of flange 12, as shown in FIG. 13, whereby the surface 62 may be flat or slightly convexly curved so as to enable heat-sealing of the flexible cover sheet 36 thereto, as indicated hereinbefore. The ramp 58 facilitates removal of the contact lens from cavity 52 upon peeling off of the cover sheet 36.

Also in this embodiment as in the embodiment of FIGS. 1 to 4, does the planar flange 12 possess a depending wall structure 30 extending about and within the entire perimeter thereof slightly inwardly of its peripheral edges 14, 16 so as to form a stiffening or reinforcing structure and locating feature as described hereinbefore.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A packaging arrangement for the sealed containment of at least one hydrophilic contact lens in a sterile aqueous solution; comprising:

(a) at least one injection molded or thermo-formed plastic base member having a cavity for containing a contact lens immersed in said solution, said base member including a planar flange extending outwardly about the periphery of the outer edge of said cavity, said cavity consisting of an indentation extending from the plane of the upper surface of said flange, a depending wall projecting downwardly from a bottom surface of said flange closely inwardly of the peripheral edges of said flange and extending about at least portions of the periphery of said flange wherein said depending wall comprises a groove formed in the upper surface of said flange; and (b) a flexible cover sheet superimposed over said base member and dimensioned to be detachably sealed to upper surface areas of said flange for sealingly enclosing said cavity and where peripheral portions of the cover sheet are pushed into the groove.

2. A packaging arrangement as claimed in claim 1, wherein said flange is rectangular and the cavity in said molded plastic base member is offset towards one end edge of said flange.

3. A packaging arrangement as claimed in claim 1, wherein the upper surface of said flange has a raised surface area extending about said cavity facing said superimposed cover sheet in contacting relationship.

4. A packaging arrangement as claimed in claim 3, wherein a seal is formed between said cover sheet and at least the raised surface of said flange sealingly extending about the periphery of said cavity.

5. A packaging arrangement as claimed in claim 4, wherein said seal comprises a heat seal.

6. A packaging arrangement as claimed in claim 3, wherein said raised surface is convexly curved in transverse cross-section.

7. A packaging arrangement as claimed in claim 1, wherein said groove extends about the entire periphery of said flange.

8. A packaging arrangement as claimed in claim 1, wherein said depending wall forms a stiffening element for said flange.

9. A packaging arrangement as claimed in claim 1, wherein said depending wall acts as a locating structure during handling and/or manufacturing processes.

10. A packaging arrangement as claimed in claim 1, wherein said depending wall is integrally formed with said flange.

11. A packaging arrangement as claimed in claim 2, wherein said depending wall extends along three sides of said flange including an end edge distant from said cavity and along two side edges and terminating proximate said cavity.

12. A packaging arrangement as claimed in claim 11, wherein said depending wall defines a U-shaped configuration.

13. A packaging arrangement as claimed in claim 1, wherein said groove is U-shaped in transverse cross-section.

14. A packaging arrangement as claimed in claim 1, wherein said cavity is generally hemispherical in shape.

15. A packaging arrangement as claimed in claim 1, wherein said cavity has an upper portion of frusto-conical cylindrical shape narrowing towards a lower end, and said lower end extends into a semi-spherical bottom for said cavity.

16. A packaging arrangement as claimed in claim 1, wherein said cavity is generally hemispherical and includes an upwardly and outwardly inclined ramp portion extending to the upper surface of said flange.

17. A packaging arrangement as claimed in claim 16, wherein said ramp narrows along the upward incline thereof in a generally frusto-conical configuration.

18. A packaging arrangement as claimed in claim 1, wherein said plastic base member comprises a thermoformable polymer.

19. A packaging arrangement as claimed in claim 1, wherein said flexible cover sheet has an expanse which is dimensioned to be within the confines of the periphery of said base member.

20. A packaging arrangement as claimed in claim 1, wherein said flexible cover sheet is dimensioned to interconnect a plurality of said base members in a strip-like array for the containment of a specified number of said contact lenses arranged one in each cavity of each of said base members.

21. A packaging arrangement as claimed in claim 20, wherein said flexible cover sheet commonly extends over said plurality of base members and is sealingly connected to each said flange of respectively each said base member.

22. A packaging arrangement as claimed in claim 21, wherein said flexible cover sheet connects said plurality of base members in a coplanar array.

23. A packaging arrangement as claimed in claim 1, wherein said packaging arrangement comprises an individual blister package containing a single contact lens.

24. A packaging arrangement as claimed in claim 2, wherein said flexible cover sheet has a substantially rectangular configuration.

25. A packaging arrangement as claimed in claim 1, wherein said flexible cover sheet is a multi-layered laminate having a layer of said laminate consisting of a thermoplastic film contacting upper surface portions of the flange of said molded plastic base member.

26. A packaging arrangement as claimed in claim 25, wherein said thermoplastic film is heat-sealed to said flange surface of the base member for sealing the cavity containing the contact lens.

27. A packaging arrangement as claimed in claim 1, wherein said base member and said flexible cover sheet conjointly form a moisture and vapor-imperviously sealed containment for said contact lens in said cavity.

28. A packaging arrangement as claimed in claim 25, wherein said flexible cover sheet comprises a foil laminate.

29. A packaging arrangement as claimed in claim 25, wherein said flexible cover sheet is transparent and comprises at least one silicon oxide barrier layer and a plurality of plastic layers.

30. In a packaging arrangement for the sealed containment of at least one hydrophilic contact lens in a sterile aqueous solution; the improvement comprising at least one injection molded or thermo-formed plastic base member having a cavity for containing a contact lens immersed in said solution, said base member including a planar flange extending outwardly about the periphery of the outer edge of said cavity, said cavity consisting of an indentation extending from the plane of the upper surface of said flange, and a depending wall projecting downwardly from a bottom surface of said flange closely inwardly of the peripheral edges of said flange and extending about at least portions of the periphery of said flange, and wherein said depending wall comprises a groove formed in the upper surface of said flange, the upper surface of said flange has a raised surface area extending about said cavity, a seal is formed between a flexible cover sheet and at least the raised surface of said flange sealingly extending about the periphery of said cavity, and said cover sheet is pushed into the groove.

31. A packaging arrangement as claimed in claim 30, wherein said flange is rectangular and the cavity in said molded plastic base member is offset towards one end edge of said flange.

32. A packaging arrangement as claimed in claim 30, wherein said seal comprises a heat seal.

33. A packaging arrangement as claimed in claim 30, wherein said raised surface is convexly curved in transverse cross-section.

34. A packaging arrangement as claimed in claim 30, wherein said depending wall extends about the entire periphery of said flange.

35. A packaging arrangement as claimed in claim 30, wherein said depending wall forms a stiffening element for said flange.

36. A packaging arrangement as claimed in claim 30, wherein said depending wall is integrally formed with said flange.

37. A packaging arrangement as claimed in claim 31, wherein said depending wall extends along three sides of said flange including an end edge distant from said cavity and along two side edges and terminating proximate said cavity.

38. A packaging arrangement as claimed in claim 37, wherein said depending wall defines a U-shaped configuration.

39. A packaging arrangement as claimed in claim 30, wherein said groove is U-shaped in transverse cross-section.

40. A packaging arrangement as claimed in claim 30, wherein said cavity is generally hemispherical in shape.

41. A packaging arrangement as claimed in claim 30, wherein said cavity has an upper portion of frusto-conical cylindrical shape narrowing towards a lower end, and said lower end extends into a semi-spherical bottom for said cavity.

42. A packaging arrangement as claimed in claim 30, wherein said cavity is generally hemispherical and includes an upwardly and outwardly inclined ramp portion extending to the upper surface of said flange.

43. A packaging arrangement as claimed in claim 42, wherein said ramp narrows along the upward incline thereof in a generally frusto-conical configuration.

44. A packaging arrangement as claimed in claim 30, wherein said plastic base member comprises a thermoformable polymer.

* * * * *